US005194024A

United States Patent [19]

Shiraki

[11] Patent Number: 5,194,024

[45] Date of Patent: Mar. 16, 1993

[54] PROPELLER DRIVEN SURFBOARD

[76] Inventor: Wilton F. Shiraki, 115 Maile Lau Li'l Pl., Hilo, Hi. 96720

[21] Appl. No.: 801,426

[22] Filed: Dec. 2, 1991

[51] Int. Cl.[5] ..... B63H 16/20

[52] U.S. Cl. ..... 440/29; 440/30

[58] Field of Search ..... 440/21, 24, 26, 29, 440/30

[56] References Cited

U.S. PATENT DOCUMENTS

| | | | |
|---|---|---|---|
| 2,668,513 | 2/1954 | Reynolds | 440/24 |
| 3,272,173 | 9/1966 | Avellino | 440/29 |
| 4,170,188 | 10/1979 | Jamison, Jr. | 440/30 |
| 4,795,381 | 1/1989 | Willems | 440/26 |

FOREIGN PATENT DOCUMENTS

| | | | |
|---|---|---|---|
| 945347 | 5/1949 | France | 440/26 |
| 2596017 | 9/1987 | France | 440/26 |

*Primary Examiner*—Sherman Basinger
*Attorney, Agent, or Firm*—Michael I. Kroll

[57] ABSTRACT

A propeller driven surfboard is provided which consists of a hull having a nose at the bow and a tail at the stern. A skeg is mounted to the underside of the hull, while a seat having a support structure is mounted onto the hull between the nose and tail thereof for a person to sit on. A mechanism is mounted in the hull in front of the seat, for propelling the hull along a body of water. Another mechanism is mounted in the hull in back of the seat, for steering the hull along the body of water.

7 Claims, 2 Drawing Sheets

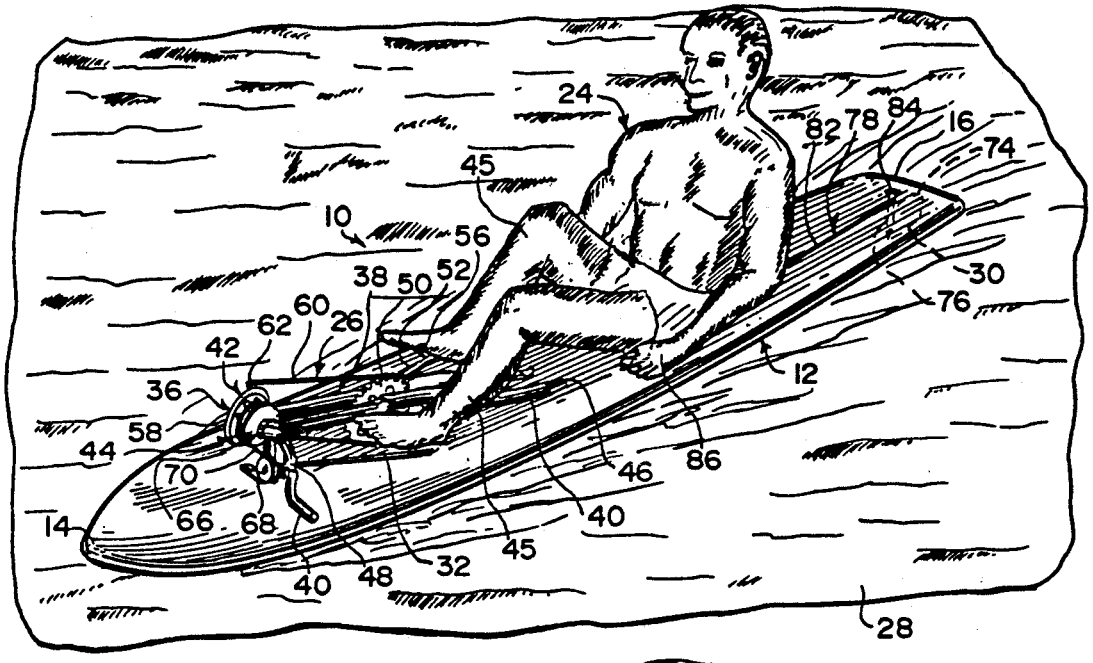
Fig. 1
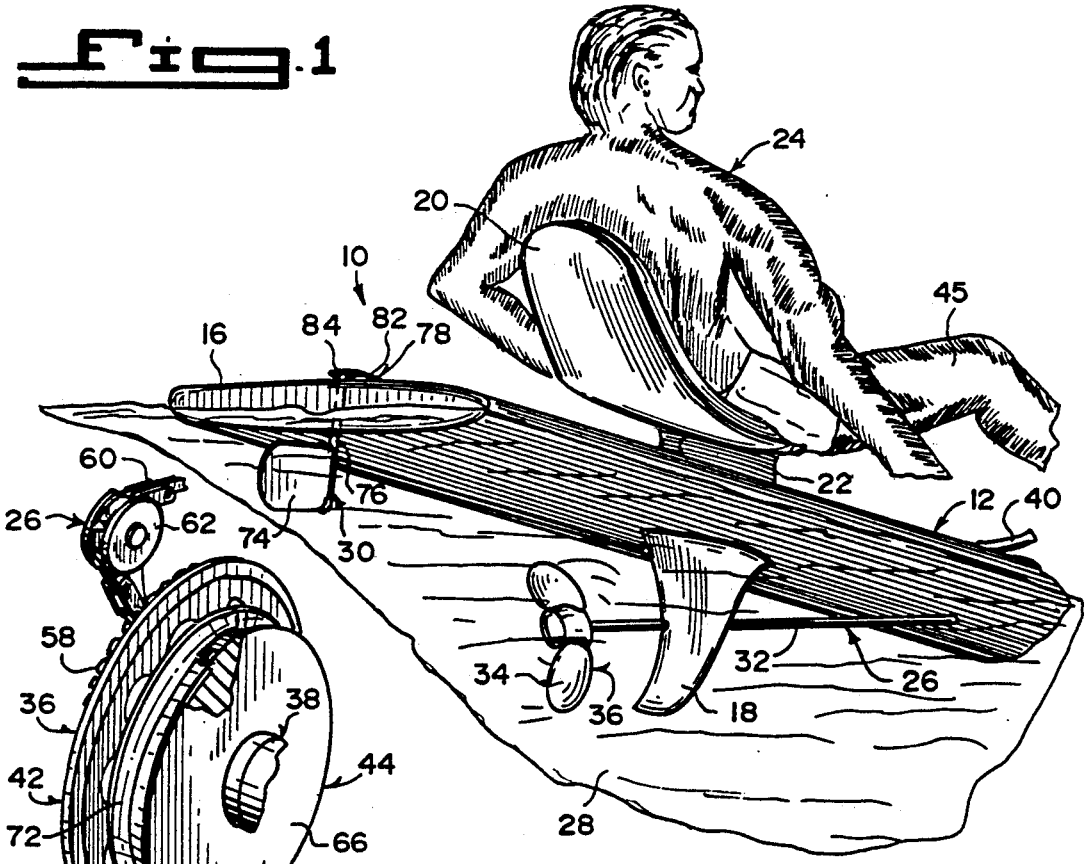
Fig. 5
Fig. 2

PROPELLER DRIVEN SURFBOARD

BACKGROUND OF THE INVENTION

1. Field of the Invention

The instant invention relates generally to surfing equipment and more specifically it relates to a propeller driven surfboard.

2. Description of the Prior Art

Numerous surfing equipment have been provided in prior art that are adapted to be utilized in the sport of riding the crests or waves, especially on surfboards and wind surfers. While these units may be suitable for the particular purpose to which they address, they would not be as suitable for the purposes of the present invention as heretofore described.

SUMMARY OF THE INVENTION

A primary object of the present invention is to provide a propeller driven surfboard that will overcome the shortcomings of the prior art devices.

Another object is to provide a propeller driven surfboard that is operated by pedal power from the legs of a person sitting on a seat on the surfboard.

An additional object is to provide a propeller driven surfboard that is steered by the person sitting on the seat on the surfboard controlling a rudder at the stern.

A further object is to provide a propeller driven surfboard that is simple and easy to use.

A still further object is to provide a propeller driven surfboard that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of the instant invention being used in a body of water.

FIG. 2 is a rear perspective view of the instant invention with parts broken away being used in the body of water.

FIG. 5 is an enlarged perspective view with parts broken away and in section, showing a portion of the manually driving mechanism.

DETAILED DESCRIPTION OF THE PREFERRED EMBODIMENTS

Figures 3, 4:
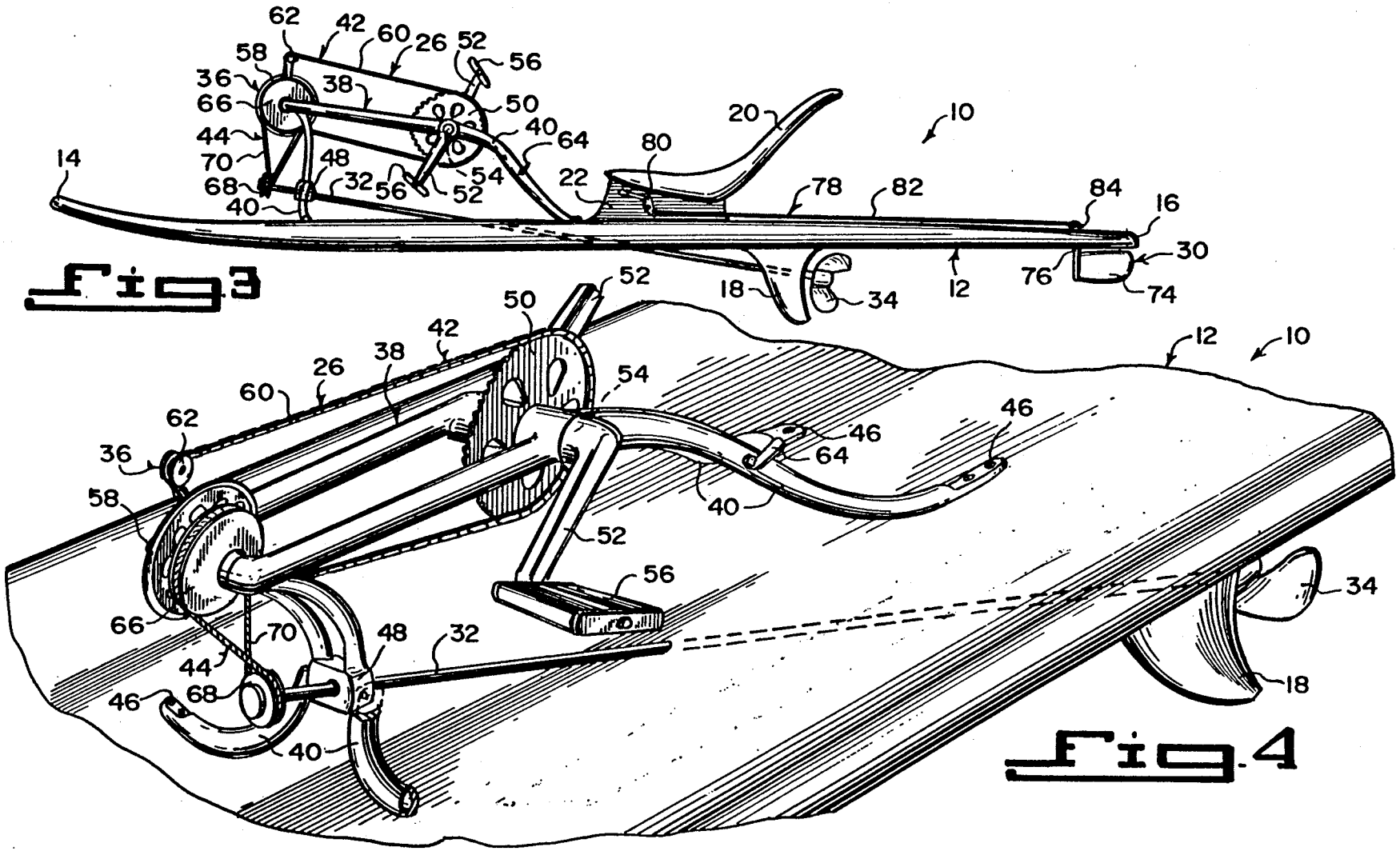
FIG. 3 is a side view of the instant invention.
FIG. 4 is an enlarged perspective view of a portion of the instant invention showing the mechanism for manually driving the propeller.

Turning now descriptively to the drawings, in which similar reference characters denote similar elements throughout the several views, the Figures illustrate a propeller driven surfboard 10, which consists of a hull 12 having a nose 14 at the bow and a tail 16 at the stern. A skeg 18 is mounted to the underside of the hull 12, while a seat 20 having a support structure 22 is mounted onto the hull 12 between the nose 14 and tail 16 thereof for a person 24 to sit on. A mechanism 26 is mounted in the hull 12 in front of the seat 20, for propelling the hull

12 along a body of water 28. Another mechanism 30 is mounted in the hull 12 in back of the seat 20, for steering the hull 12 along the body of water 28.

The propelling mechanism 26 includes an elongated shaft 32 extending angularly through the hull 12 and the skeg 18. A propeller 34 is mounted onto a lower end of the elongated shaft 32 within the body of water 28. A mechanism 36 is mounted on the hull 12 in front of the seat 20 for manually rotating the elongated shaft 32 by the person 24 sitting on the seat 20, so that the propeller 34 will turn within the body of water 28 to propel the hull 12 along the body of water 28.

The manually rotating mechanism 36 includes a frame member 38 having a plurality of legs 40 mounted onto the hull 12 in front of the seat 20. A crankset assembly 42 is rotatably mounted to the frame member 38. A rope pulley assembly 44 is connected between one end of the crankset assembly 42 and an upper end of the elongated shaft 32, so that the legs 45 of the person 24 sitting in the seat 20 can operate the crankset assembly 42 to operate the rope pulley assembly 44 to turn the elongated shaft 32.

Each of the legs 40 of the frame member 38 are mounted onto the hull 12 by a fastener 46, wherein the fastener 46 is a screw or the like. The frame member 38 includes a bearing 48 supported between the forward legs 40, so that the elongated shaft 32 can extend through the bearing 48 and be rotatably supported therein. The bearing 48 also transfers the forward thrust of the propeller 34 to the frame member 38.

The crankset assembly 42 includes a sprocket 50 rotatably mounted on the frame member 38. A pair of crank arms 52 have a crank axle 54 connected to the sprocket 50. A pair of pedals 56 are also provided, with each rotatably mounted on a distal end of one crank arm 52. A gear cluster 58 is rotatably mounted on the frame member 38 at a spaced away distance from the sprocket 50. A continuous drive chain 60 extends between the sprocket 50 and the gear cluster 58. A tension wheel 62 is mounted to the frame member 38 and is in engagement with the continuous drive chain 60.

A speed control lever 64 is mounted on one of the rearward legs 40 of the frame member 38. The speed control lever 64 is mechanically connected to the gear cluster 58 to change the speed of rotation of the gear cluster 58.

The rope pulley assembly 44 includes a first pulley 66 rotatably mounted with the gear cluster 58 on the frame member 38. A second pulley 68 is mounted onto the upper end of the elongated shaft 32 below and at a right angle to the first pulley 66. A continuous rope belt 70 extends about the first pulley 66 and the second pulley 68. When the first pulley 66 rotates the continuous rope belt 70 will transfer the rotation to the second pulley 68 to turn said elongated shaft 32.

A non-slip band 72 is placed within an annular groove in the first pulley 66 and in an annular groove in the second pulley 68 to prevent the continuous rope belt 70 from slipping therebetween.

The steering mechanism 30 includes a rudder 74 having a shaft 76 pivotally mounted near the tail 16 of the hull 12, so that the rudder 74 will extend downwardly into the body of water 28. A mechanism 78 is mounted on the seat 20, for manually operating the rudder 74 by the person 24 sitting on the seat 20, so that the rudder 74 will direct the course of the hull 12 through the body of water 28.

The manually operating mechanism 78 includes a rudder control lever 80 mounted to the side of the support structure 22 under the seat 20. An elongated cable 82 is connected between the rudder control lever 80 and a top end 84 of the shaft 76 of the rudder 74 that extends through the hull 12, so that operation of the rudder control lever 80 by a hand 86 of the person 24 in the seat 20 will turn the rudder 74.

LIST OF REFERENCE NUMBERS

10 propeller driven surfboard
12 hull
14 nose
16 tail
18 skeg
20 seat
22 support structure
24 person
26 propelling mechanism
28 body of water
30 steering mechanism
32 elongated shaft
34 propeller on 32
36 manually rotating mechanism
38 frame member
40 leg of 38
42 cranks assembly
44 rope pulley assembly
45 leg of 24
46 fastener (screw or the like)
48 bearing in 38
50 sprocket
52 crank arm
54 crank axle
56 pedal
58 gear cluster
60 continuous drive chain
62 tension wheel
64 speed control lever
66 first pulley
68 second pulley
70 continuous rope belt
72 non-slip band
74 rudder
76 shaft of 74
78 manually operating mechanism
80 rudder control lever
82 elongated cable
84 top end of 76
86 hand of 24

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A propeller driven surfboard which comprises:

a) a hull having a nose at the bow and a tail at the stern;

b) a skeg mounted to the underside of said hull;

c) a seat having a support structure mounted onto said hull between the nose and tail thereof for a person to sit on;

d) means mounted in said hull in front of said seat for propelling said hull along a body of water, said propelling means including an elongated shaft extending angularly through said hull and said skeg, a propeller mounted onto a lower end of said elongated shaft within the body of water, and means mounted on said hull in front of said seat for manually rotating said elongated shaft by the person sitting on said seat so that said propeller will turn within the body of water, said manually rotating means including a frame member having a plurality of legs mounted onto said hull in front of said seat, said plurality of legs including forward legs and rearward legs, each of said legs of said frame member being mounted onto said hull by a fastener, said fastener being a screw, said frame member including a bearing supported between said forward legs so that said elongated shaft can extend through said bearing and be rotatably supported therein while said bearing also transfers the forward thrust of said propeller to said frame member, said manually rotating means further including a crankset assembly rotatably mounted to said frame member, and a rope pulley assembly connected between one end of said crankset assembly and an upper end of said elongated shaft so that the legs of the person sitting in said seat can operate said crankset assembly to operate said rope pulley assembly to turn said elongated shaft; and e) means mounted in said hull in back of said seat for steering said hull along the body of water.

2. A propeller driven surfboard as recited in claim 1, wherein said crankset assembly includes:

a) a sprocket rotatably mounted on said frame member;

b) a pair of crank arms having a crank axle connected to said sprocket;

c) a pair of pedals, each rotatably mounted on a distal end of one said crank arm;

d) a gear cluster rotatably mounted on said frame member at a spaced away distance from said sprocket;

e) a continuous drive chain extending between said sprocket and said gear cluster; and f) a tension wheel mounted to said frame member and is in engagement with said continuous drive chain.

3. A propeller driven surfboard as recited in claim 2, further including a speed control lever mounted on one of said rearward legs of said frame member, in which said speed control lever is mechanically connected to said gear cluster to change the speed of rotation of said gear cluster.

4. A propeller driven surfboard as recited in claim 3, wherein said rope pulley assembly includes:

a) a first pulley rotatably mounted with said gear cluster on said frame member;

b) a second pulley mounted onto the upper end of said elongated shaft below and at a right angle to said first pulley; and c) a continuous rope belt extending about said first pulley and said second pulley, so that when said first pulley rotates said continuous rope belt will transfer the rotation to said second pulley to turn said elongated shaft.

5. A propeller driven surfboard as recited in claim 4, further including a pair of non-slip bands, each placed within an annular groove in said first pulley and in an annular groove in said second pulley to prevent said continuous rope belt from slipping therebetween.

6. A propeller driven surfboard as recited in claim 5, wherein said steering means includes:

a) a rudder having a shaft pivotally mounted near the tail of said hull, so that said rudder will extend downwardly into the body of water;

b) means mounted on said seat, for manually operating said rudder by the person sitting on said seat, so that said rudder will direct the course of said hull through the body of water.

7. A propeller driven surfboard as recited in claim 6, wherein said manually operating means includes:

a) a rudder control lever mounted to the side of said support structure under said seat; and b) an elongated cable connected between said rudder control lever and a top end of said shaft of said rudder that extends through said hull, so that operation of said rudder control lever by a hand of the person in said seat will turn said rudder.

* * * * *